US010663263B2

(12) United States Patent
Boyd, III

(10) Patent No.: US 10,663,263 B2
(45) Date of Patent: May 26, 2020

(54) BALLISTIC RESISTANT BINDER INSERT AND PLATE CARRIER

(71) Applicant: Ben H Boyd, III, Fort Worth, TX (US)

(72) Inventor: Ben H Boyd, III, Fort Worth, TX (US)

( * ) Notice: Subject to any disclaimer, the term of this patent is extended or adjusted under 35 U.S.C. 154(b) by 0 days.

(21) Appl. No.: 15/493,305

(22) Filed: Apr. 21, 2017

(65) Prior Publication Data

US 2017/0307337 A1 Oct. 26, 2017

Related U.S. Application Data

(60) Provisional application No. 62/326,025, filed on Apr. 22, 2016.

(51) Int. Cl.

| | |
|---|---|
| ***F41H 5/08*** | (2006.01) |
| ***F41H 5/013*** | (2006.01) |
| ***A45C 1/00*** | (2006.01) |
| ***B42F 7/08*** | (2006.01) |

(52) U.S. Cl.

CPC ..... *F41H 5/013* (2013.01); *A45C 1/00* (2013.01); *B42F 7/08* (2013.01)

(58) Field of Classification Search

CPC ..... B42F 7/08; F41H 5/08; A45C 3/02; A45C 13/02; A45C 5/02

USPC ..... 229/67.3, 67.4; 206/425, 232, 308.1

See application file for complete search history.

(56) References Cited

U.S. PATENT DOCUMENTS

| | | | | | |
|---|---|---|---|---|---|
| 1,261,159 | A * | 4/1918 | Olwell | A45C 13/262 | 190/109 |
| 1,794,560 | A * | 3/1931 | Styll | B42F 7/02 | 229/67.3 |
| 3,904,003 | A * | 9/1975 | Margerum | A45C 9/00 | 190/11 |
| 4,546,863 | A * | 10/1985 | Kaufman | A45C 3/02 | 109/49.5 |
| 4,936,454 | A * | 6/1990 | Wang | B42F 7/06 | 206/425 |
| 5,020,673 | A * | 6/1991 | Adams | A45C 3/00 | 150/112 |
| 5,149,203 | A * | 9/1992 | Sacks | A45C 3/00 | 190/125 |
| 5,593,086 | A * | 1/1997 | Ho | B42F 7/08 | 229/67.3 |
| 5,630,509 | A * | 5/1997 | Su | B42F 7/08 | 206/425 |
| 5,664,724 | A * | 9/1997 | Ho | B42F 7/08 | 206/425 |
| 5,749,666 | A * | 5/1998 | Yu | B42F 7/08 | 281/29 |
| 5,947,279 | A * | 9/1999 | Lee | B42F 7/08 | 206/232 |
| 5,954,170 | A * | 9/1999 | Chisholm | A45C 3/02 | 150/107 |

(Continued)

*Primary Examiner* — Michael D David

(57) ABSTRACT

The present invention is an adjustable ballistic binder insert, which allows the user to customize the level of protection desired by inserting different ballistic defeating materials into the carrier pocket. The components of the invention are a plurality of armor fabric layers that create a pocket, a method of connecting to the binder or folder, and a ballistic defeating material insert that is able to be removed and replaced as well as a temporary method of closing the pocket to contain the inserted panel, which, generally speaking, are configured as described.

5 Claims, 5 Drawing Sheets

(56) References Cited

U.S. PATENT DOCUMENTS 5,984,092 A * 11/1999 Heard-Willmon ..... A45C 13/02 206/232
6,161,738 A * 12/2000 Norris ..... A45C 9/00 109/49.5
D448,799 S * 10/2001 Moor ..... D19/26
6,296,112 B1 * 10/2001 Pettey ..... B65D 85/546 206/232
6,364,110 B2 * 4/2002 Johnson ..... A45C 3/00 190/901
6,419,083 B1 * 7/2002 Huang ..... G11B 33/0444 206/308.1
6,431,779 B1 * 8/2002 Moor ..... A45C 7/0068 281/29
6,578,706 B2 * 6/2003 Thompson ..... A45C 3/02 206/214
6,607,122 B1 * 8/2003 Ong ..... B42F 7/08 150/113
6,672,439 B2 * 1/2004 Platte, III ..... A45C 3/02 190/103
6,685,071 B2 * 2/2004 Prather ..... A45C 15/00 2/2.5
6,837,368 B1 * 1/2005 Chang ..... G11B 33/0444 206/232
D513,279 S * 12/2005 Hough ..... D19/86
D521,072 S * 5/2006 Hough ..... D19/90
7,055,682 B1 * 6/2006 Domotor ..... A45C 11/24 206/214
D529,963 S * 10/2006 Hough ..... D19/90
7,441,278 B2 * 10/2008 Blakeley ..... F41C 33/06 2/102
7,699,165 B2 * 4/2010 Moeller ..... A45C 11/00 150/113
7,909,234 B2 * 3/2011 Maistrellis ..... A45C 11/00 150/112
2007/0295772 A1 * 12/2007 Woodmansee ..... A45F 3/047 224/576
2009/0014490 A1 * 1/2009 Bradley ..... A45C 13/008 224/576
2009/0166400 A1 * 7/2009 Lee ..... B42F 7/08 229/67.3
2011/0097021 A1 * 4/2011 Curran ..... A45C 3/001 383/109
2011/0272232 A1 * 11/2011 Sheikh ..... A45C 5/03 190/111
2015/0047940 A1 * 2/2015 Casas ..... A45C 13/36 190/127
2015/0048133 A1 * 2/2015 Alba ..... F41H 5/08 224/576
2015/0159979 A1 * 6/2015 Berringer ..... F41H 5/08 229/67.3

* cited by examiner

BALLISTIC RESISTANT BINDER INSERT AND PLATE CARRIER

BACKGROUND OF THE INVENTION

1. Field of the Invention

The present invention relates generally to A ballistic resistant binder insert and plate carrier.

2. Background

Currently there are a number of solutions for portable and discreet ballistic protection. Some of these solutions attempt to protect against hand guns only, but these solutions fail to meet the needs of the industry because many of the recent school and public shootings have involved high powered rifles. Other solutions attempt to protect against rifle power but are too heavy or indiscreet for children. These solutions are similarly unable to meet the needs of the industry because of the weight. Still other solutions seek to offer protection by building the protection into the backpack or bag itself, but these solutions also fail to meet industry needs because they are very costly and the backpacks or bags are offered in limited styles and tend to wear out after a couple years which would require another costly purchase to maintain the protection. These limitations do not allow the protection to be incorporated into the child's favorite existing type or style of backpack. It would be desirable to have a method of protecting teachers and students against public shootings which can adjust to fit the student's age and physical capabilities as well as desired protection level. Furthermore, it would also be desirable to have this protection be discreet, and incorporated into their daily routine. Still further, it would be desirable to have this protection offered at an affordable price and or in increments where additional or greater protections can be purchased separately over time to spread out the cost. Therefore, there currently exists a need in the personal protection industry for a discrete ballistic protective device that allows a great deal of flexibility in how it is purchased, the amount of protection desired, and the weight able to be tolerated by students and teachers from preschool age to adult.

SUMMARY OF THE INVENTION

The present invention advantageously fills the aforementioned deficiencies by providing a ballistic resistant binder insert and plate carrier which provides a cost effective way to provide an adjustable amount of ballistic threat protection based on budget, size of child and desired threat protection that can discretely be incorporated into their current folder, binder and school bags.

The present invention is a ballistic resistant binder insert and plate carrier, which is made up of the following components. 1) A plurality of armor fabric layers affixed in a way to create a pocket. 2) A method of connecting the device to a three ring binder or school folder. 3) An additional panel of ballistic resistant material that can be fully inserted into the pocket. 4) A method of closing the pocket to prevent the insert from falling out, but can then be reopened as desired by the user. These components are connected as follows. The plurality of armor fabric layers is affixed on at least one edge but no more than three sides by sewing or the like. The front and back components of the pocket should be of substantially equal number of layers of armor fabric. The opening of the pocket will have a method of closure such as snaps, zipper, hook and loop, laces and such that allows the user to reopen the pocket as desired. The additional protective insert could be composed of but not limited to Steel, Aluminum, Titanium and their alloys, fiberglass, pressed armor fabric and their composites, or other traditional ballistic resistant materials.

The present invention may also have one or more of the following: The size may be expanded to accommodate a legal pad, day planner, portfolio book or as a briefcase insert. The invention could be concealed in a faux book or notepad as a standalone or within the binder or folder. The connection to the binder could be to the rings, base of rings, or spine that holds the rings, or built into the cover or attached to the covers of the binder or folder itself. The invention could also be inserted into a pocket of the binder or folder. The armor fabric creating the pocket may be contained within non armor fabric for aesthetic or manufacturing purposes. A rigid or semi rigid composite could be used in place of the armor fabric to create the pocket. A heavy denier armor fabric may potentially substitute in a singular fashion in place of the plurality or layers used to create the pocket. A singular panel with a composite mix of materials could be used instead of the interchangeable system. The temporary closure system could be with a zipper, hook and loop, snap, lacing, or adhesive gel or putty type substance.

The present invention is unique when compared with other known devices and solutions because the present invention provides the ability for children of any age to carry with them an amount of protection that would protect them from handguns which account for more than half of the calibers that have been used in recent shootings. This insert is discreet and only adds several ounces and can be added to the students existing school folders or binders and kept in their existing backpack. The invention can then be modified by interchanging the type of armor panel that is inserted into the pocket to protect against almost 100% of the ballistic threats that faculty and students have faced in the recent years. This invention allows for the incremental increase in protection as the student grows and can comfortably carry the heavier weight that is associated with metal plates, and the like, which are needed to provide protection from high power rifle bullets.

The present invention is unique in that it is structurally different from other known devices or solutions. More specifically, the present invention is unique due to the presence of: (1) The pocket created by the front and back panels of ballistic resistant armor fabric; (2) The ability to insert various additional ballistic materials into the pocket. 3) The inclusion of a temporary closure system which can securely shut the pocket thus allowing the addition of the previously mentioned ballistic materials and effectively increasing the devices resistance to more types of threats and (3) the fastening system directly to the spine, allowing the device to hold the extra weight of metal plates without accidentally opening the binder rings. (4) The invention is further unique in that it provides this flexible and discreet protection in a system that can be added to generally any mass produced binder or folder.

Among other things, it is an object of the present invention to provide A ballistic resistant binder insert and plate carrier that does not suffer from any of the problems or deficiencies associated with prior solutions.

It is still further an object of the present invention to create a device that can be adapted as the child grows to allow for greater threat mitigation as the child is able to handle heavier armor components up to and including the weight associated with that of steel plate or ceramic composites which are needed to defeat high power rifle threats.

Further still, it is an object of the present invention to allow the various types of protective inserts to be purchased separately so the cost can be spread out over time as needed.

Further still, it is an object of the present invention to be able to be incorporated discreetly into the child's current and future school supplies.

The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

BRIEF DESCRIPTION OF THE DRAWINGS

FIG. 5 shows a top view cross section illustrating the plurality of layers in the front and back panels and metal plate in between.

DETAILED DESCRIPTION OF THE INVENTION

The present invention is directed to a ballistic resistant binder insert and plate carrier.

In its most complete version the present invention is a ballistic resistant binder insert and plate carrier, which is made up of the following components. 1) A plurality of armor fabric layers divided into substantially equal number to create a front and back panel, then each would be enclosed by a non ballistic fabric for aesthetics and discreetness, and sewn on the bottom and side with closest proximity to the spine of the folder thus creating a semi pocket. 2) The edge opposite the spine would have a method or temporary closure that extended the full length of that side and along the top of the device to complete the full perimeter of the substantially rectangular shape and completing the pocket. The closure method would be by zipper, snap, or hook and loop. This temporary closure around the pocket would allow the insertion of 3) an additional panel of ballistic resistant material either hardened steel, aluminum and its alloys, Titanium and its alloys, pressed armor composites, fiberglass, or additional layers of armor fabric which can be then removed and interchanged if desired. 4) The method of connecting the device to a three ring binder would be directly to the spine to alleviate the potential of the weight, when carrying the metal plates, from accidentally open the rings. This is accomplished by two or more thick strips of fabric extending from the front panel, wrapping around the binder spine in between the rings, then inserted under the spine and affix by hook and loop, snap, D ring buckle, or other common method to the back of the back panel.

The following discussion of the preferred embodiments of the present invention is merely exemplary in nature. Accordingly, this discussion of the present invention in no way is intended to limit the scope of the present invention, or the application of the present invention of the use of the present invention.

Figure 1:
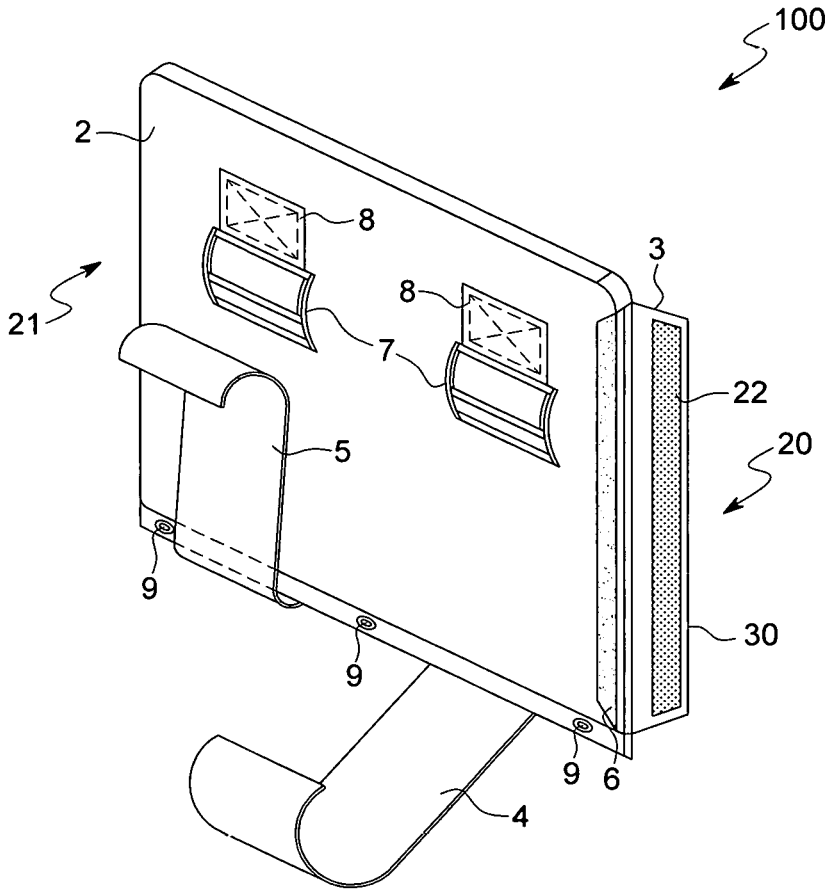
FIG. 1 shows a back view of the device while closed.
Figure 3:
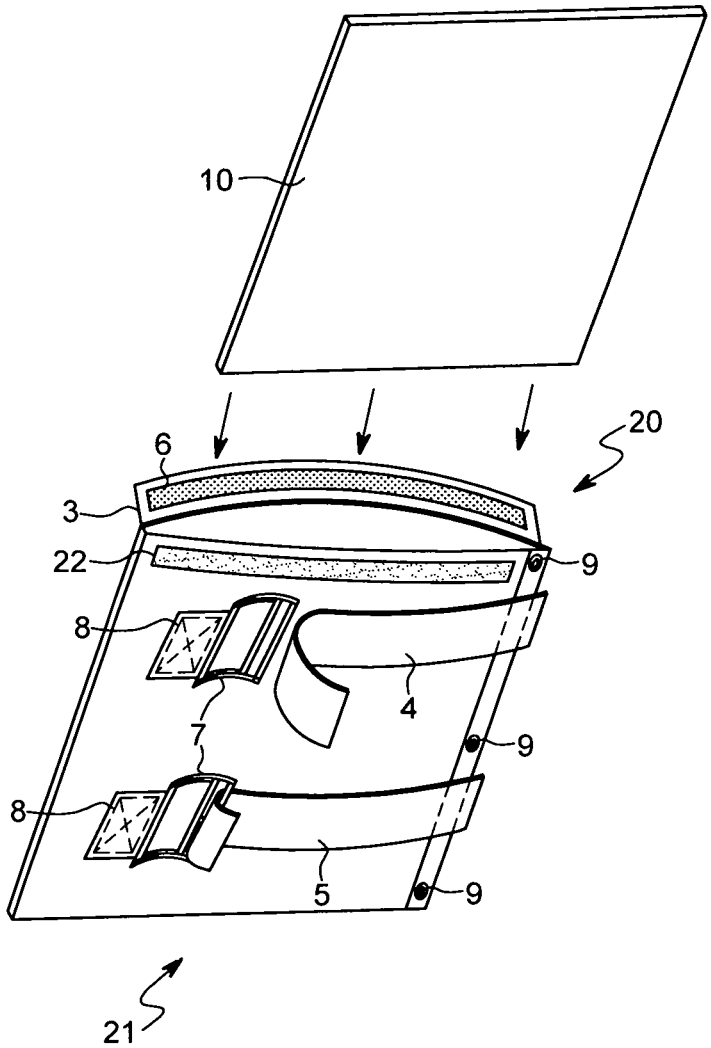
FIG. 3 shows the back view of the device open and receiving a plate insert

Referring to FIG. 1. The back panel 2 of the back section 3 of the binder 100 of the present invention. Closure flap 30 which may include a flexible portion (or hinge) to pivot between an open position and a closed position. The closure flap 30 when open, exposes the fastener to fasten the closure flap 30 including Velcro having both a Hook side 22 and a loop side 6. The top section 20 refers to the top of the binder 100 of the present invention and the bottom section 21 refers to the bottom of the binder 100 of the present invention (for orientation purposes). The binder spine straps 4, 5 which could be made of armor fabric or other durable high strength fabric, may be labeled as top binder spine strap 4 and bottom binder spine strap 5. These top and bottom binder spine straps 4, 5 can be used to secure the binder 100 of the present invention when carrying a steel insert or other heavy insert by wrapping around a support spine 15 which may be formed from steel, plastic or other type of rigid material of the binder 100 then, the binder spine straps 4 and 5 inserts into a holding device such as D rings 7 (as shown in FIGS. 1 and 3) secured to the back panel 2 by flexible material 8 which could be formed of Nylon webbing, armor fabric, or other strong material and may be looped around the D ring 7 and fastened to the back panel 2 by stitching, welding or other appropriate fastening devices. An additional method of connection to the binder when the insert is not heavy, can utilize rivets or the Grommets 9 to connect to the rings of the binder.

Figure 2:
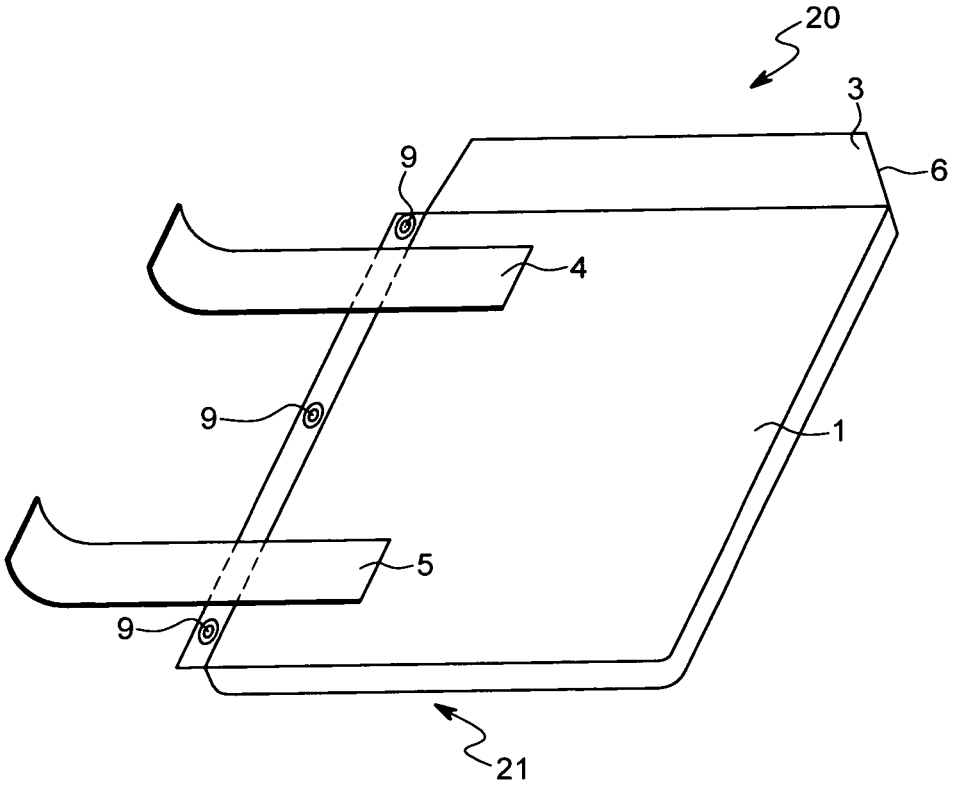
FIG. 2 shows the front view of the device while closed.

Referring to FIG. 2. the front surface of the front panel 1 is illustrated, with the closure flap 30. Additionally illustrated is loop side and 6 the Hook side 22 of the hook and loop closure system. The top section 20 of the present invention and bottom section 21 of the present invention are shown for orientation purposes. The top binder spine strap 4 and bottom spine strap 5 are affixed or sewn to front panel so that the origin of the strap starts at no less than ¼ the width of the device and positions the spine strap in close proximity to the interior side of each binder ring. 1, however they could also be integrated as part of front panel 1 instead of a separate part. The grommets 9 are to align with the spacing of the D rings 7 of the binder 100

Referring to FIG. 3. The back panel 2 is illustrated, with open closure flap 30 that exposes the hook side surface 6 and the loop side surface 22 closure system which engage to close the closure flap 30 to retain the insert 10 securely inside the cavity of the pocket/cavity in which the insert may be positioned into the present invention. The present invention may include the top section 20 being opposed to the bottom section 21 and may include the inner cover 11 of the front panel 1. With the binder 100 of the present invention open, the binder 100 engages the insert 10, which could be, but is not limited to one or more of, a plurality of armor fabric, a rigid composite plate, or a metal or alloy plate or other material. The flexibility of the material of the insert 10, allows the user to find the right balance of weight, protection, and cost to suit their needs. When a heavy insert is used such as metal or alloy, the spine straps 4, 5 should be utilized and secured around the binder support spine 15 instead of using the grommets 9 on the binder rings 7. This would reduce the chance the weight could accidentally open the rings 7 which could allow the binder insert 10 and plate holder and other contents to spill out. This is accomplished by wrapping the top binder spine strap 4, and the bottom binder spine strap 5 around the support spine 15 between the rings 7 of the binder 100. The spine straps 4 and 5 may be inserted into the D rings 7, which are held in place by the flexible material 8, which is securely attached to the back of the back panel 2.

Figure 4:
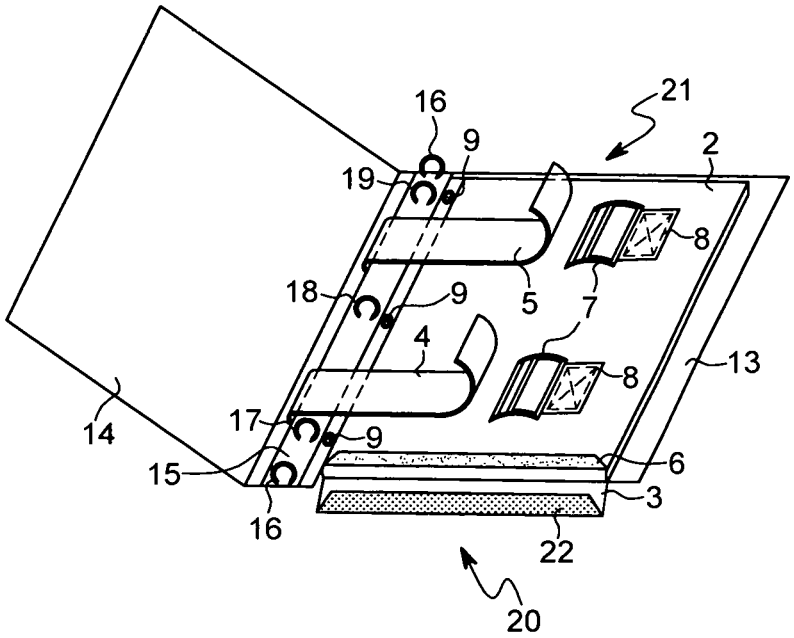
FIG. 4 shows the back of the device in a 3 ring binder affixed with the spine strap connections under the binder spine and in close proximity to the binder spine rings.

Referring to FIG. 4. The present invention is inserted in and cooperates with a standard, three ring binder, exposing the back of the binder 14. The front of the binder 13, is substantially covered by the present invention, with the top section 20 and bottom section 21 of the present invention been shown for orientation. The Closure Flap 30 is shown open at the top of the present invention exposing the hook 22 and loop 6 sides of the closure system. In this figure, the top binder spine strap 4, and bottom binder spine strap 5 are currently wrapped underneath the binder's support spine 15 between the top binder ring 17, and middle ring 18, as well as between middle ring 18, and bottom ring 19. The orientation of the top binder strap 4 and bottom binder strap 5 are positioned in such a way as to allow full movement and use of the binder rings 17, 18 and 19, and the binder opening tabs 16, for full functionality. The binder straps 4 and 5 would be inserted into the D rings 7 which are securely attached to the back panel 2, by the flexible material 8 which may be made of Nylon webbing, armor fabric, or other strong material. The grommets 9 may be metal or other common grommet material of a diameter size to allow easy insertion and removal from the binders rings 17, 18 and 19.

Figure 5:
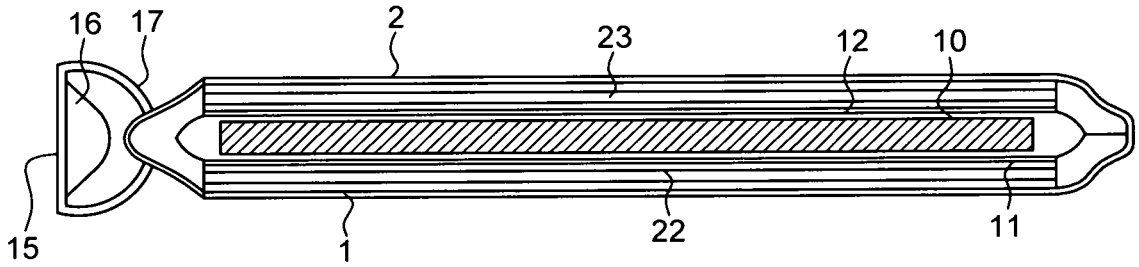

FIG. 5 illustrates in a cross sectional view from top down which illustrating the plurality of layers 22 between the exterior 1 and interior 11 of the front panel, as well as the approximate equal number of layers 23 between the interior 12 and exterior cover 2 of the back panel. Insert 10, is sandwiched in between. The present invention is affixed to the binder rings, the top ring 17 being shown here. The binder opening tab 16 and support spine 15 which may be metal or other suitable materials are shown in relation to the present invention.

The present invention is an adjustable ballistic binder insert, which allows the user to customize the level of protection desired by inserting different ballistic defeating materials into the carrier pocket. The core components of the invention are a plurality of armor fabric layers that create a pocket, a method of connecting to the binder or folder, and a ballistic defeating material insert that is able to be removed and replaced as well as a temporary method of closing the pocket to contain the inserted panel, which, generally speaking, are configured as follows: The plurality of armor fabric layers are divided into two equal panels which is the front side and the back side of the plate carrier. The front and back panels are affixed on one or more sides but no more than three sides at the edges, creating a pocket into which the additional armor panel of choice can be inserted. Once the panel is inserted, the remaining side or sides would have a method of closure such as by a zipper, snap, or hook and loop. One side will have a method of affixing the invention to the binder spine, three rings of a binder or folder. The invention can be used by students and teachers of all ages to add protection against the ballistic threats most common in previous mass shootings. The ability for the addition and removal of various material inserts will allow a certain level of protection such as NIJ level IIA for preschool age children where the added protection adds very little extra weight, up to a college student or adult, who may desire protection against a high power rifles such as NIJ level III rating which would be accomplished by the addition of a metal plate, which will add considerable extra weight. Furthermore, it should be noted that the insert carrier itself should provide at least a minimum level of protection without an insert added.

While the present invention has been described above in terms of specific embodiments, it is to be understood that the invention is not limited to these disclosed embodiments. Many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

The invention claimed is:

1. A ballistic rated binder insert to cooperate with a standard 3 ring binder comprising:

a. a back panel, b. a front panel opposed to the back panel and stitched on at least 2 sides but no more than 3 sides to form a cavity only large enough for the addition of antiballistic inserts, c. a closure flap to connect said back panel and said front panel to fully close the cavity, d. said ballistic binder insert no more than 1 inch thick, when installed, fully contained within the boundaries of said standard 3 ring binder for discreetness, and maintain functionality of the binder, e. said ballistic binder insert comprising a minimum NIJ rating of level IIa f. said ballistic binder insert is secured to a spine of said standard 3 ring binder by encircling said spine thus allowing full use of the binder's rings without interference, g. said spine is comprised of a first wide strap with a hole or a cut out which allows for clearance of a center ring of said 3 ring binder, h. said first strap being of sufficient length to wrap over the top of said spine, then inserted underneath, thus encircling said spine before attaching to said back panel, the width of said first strap is between 7.0 and 8.50 inches wide to support said ballistic binder insert, and fit between the standard spacing of the top and bottom rings of said standard 3 ring binder.

2. The ballistic rated binder insert according to claim 1 further comprising a second strap, a. said second strap of sufficient length to encircle said binder spine before attaching to said back panel by way of common attachment comprising of a D ring, hook and loop, or ladder lock to support said binder insert, b. the placement of said straps in between the top and bottom rings of said 3 ring binder with a distance between the bottom of the first strap and the top of the second strap being between 7.0 and 8.50 inches.

3. The ballistic rated binder insert according to claim 2 wherein said ballistic rated binder insert cooperates with a 2, 3, 4 or 5 ring binder, a. wherein the first strap is affixed to said front panel a maximum distance of 1 inch below the top ring and the second strap is affixed a maximum of 1 inch above the bottom ring, b. said straps are then wrapped around the binder spine before inserting between said binder spine and a back cover of the binder, c. said straps are then connected to said back panel by a D ring, hook and loop, ladder lock or other common connection device.

4. The ballistic rated binder insert according to claim 3, wherein the connection device to said spine is a clip that is made of a hard material comprising of metal or plastic that connects said ballistic rated binder insert to said binder spine, between the binder rings in place of said straps.

5. The ballistic rated binder insert according to claim 4, wherein said front and back panels are comprised of substantially equal numbers of armor fabric layers to achieve the NIJ IIa minimum ballistic rating of said ballistic binder insert.

* * * * *